US006575468B1

(12) United States Patent
Hall

(10) Patent No.: US 6,575,468 B1
(45) Date of Patent: Jun. 10, 2003

(54) METHOD AND APPARATUS FOR PLAYING A WORD GAME

(76) Inventor: Edward Kenneth Hall, 290 Elm Park Ave., Elmhurst, IL (US) 60126

( * ) Notice: Subject to any disclaimer, the term of this patent is extended or adjusted under 35 U.S.C. 154(b) by 0 days.

(21) Appl. No.: 09/596,984

(22) Filed: Jun. 20, 2000

(51) Int. Cl.[7] ..... A63F 1/00
(52) U.S. Cl. ..... 273/298; 273/138.1; 273/299
(58) Field of Search ..... 273/138.1, 292, 273/299, 302, 306

(56) References Cited

U.S. PATENT DOCUMENTS 3,606,336 A * 9/1971 Krause
3,984,106 A * 10/1976 White
4,350,342 A 9/1982 Barulich
4,402,513 A * 9/1983 Head
4,690,409 A 9/1987 Scalia
4,900,031 A * 2/1990 Wohl
4,923,199 A 5/1990 Hahn
5,310,347 A * 5/1994 Brand
5,417,432 A * 5/1995 Dwyer
5,657,994 A * 8/1997 O'Connor ..... 273/272
5,697,615 A 12/1997 Gilbert
5,743,740 A * 4/1998 Visser

* cited by examiner

*Primary Examiner*—Benjamin H. Layno
*Assistant Examiner*—V K Mendiratta
(74) *Attorney, Agent, or Firm*—Wallenstein & Wagner, Ltd.

(57) ABSTRACT

A method and apparatus for playing a word game comprising a deck of letter playing cards and a deck of number playing cards. A card from each deck is selected and a player attempts to be the first to communicate a word responsive to the selected letter and number playing cards.

4 Claims, 5 Drawing Sheets

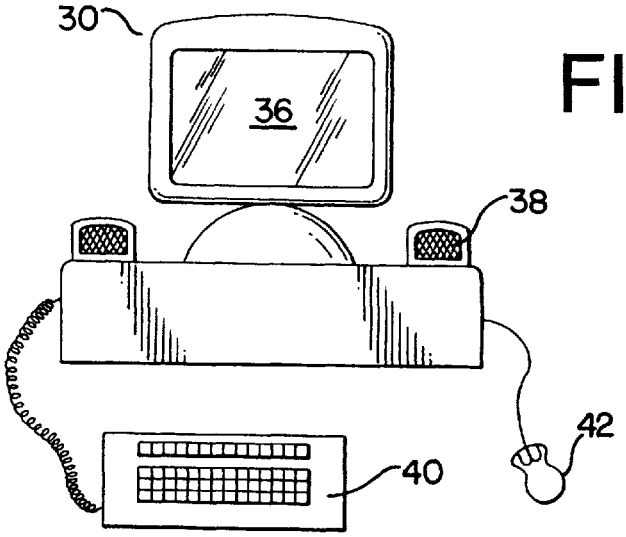
FIG. 5
FIG. 6
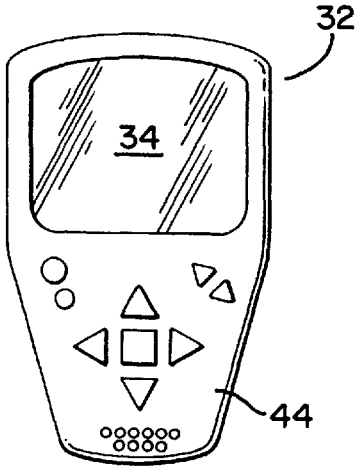
FIG. 9
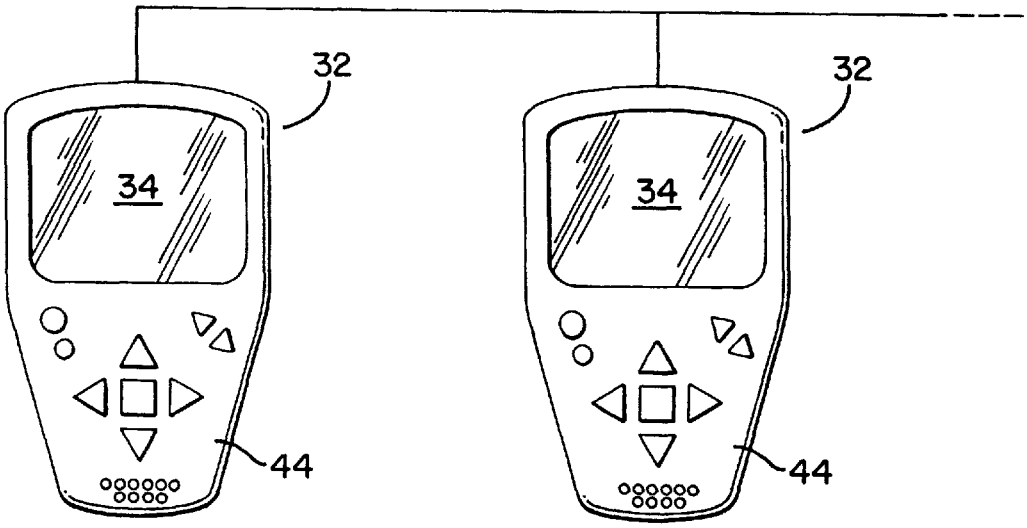

METHOD AND APPARATUS FOR PLAYING A WORD GAME

TECHNICAL FIELD

The present invention relates generally to games. More specifically, the present invention relates to a method and apparatus for playing a word game.

BACKGROUND OF THE INVENTION

There are many known games involving language in which players are challenged to work with words. Many of these games are directed to a specific level of skill and playing ability. Because the games are not easily modified, the game is incapable of being customized to progress along with a player's skill level or to be used across multiple groups of players having varying skill levels. Thus, prior to this is invention, a need existed for a word game having a skill level capable of being modified.

This invention is directed to solving these and other problems.

SUMMARY OF THE INVENTION

The principal object of the present invention is to provide a word game capable of being modified or adjusted to the level of skill of the players. A commercial representation of a word game embodying the present invention is known as WORD RACE™.

One embodiment of the present invention is directed to an apparatus for playing a word game comprising a deck of letter playing cards and a deck of number playing cards. One card from each deck is selected and the players attempt to communicate a word in response to the letter playing card and number playing card selected. More specifically, the players attempt to win points by being the first to communicate a word beginning with the letter shown on the selected letter playing card and consisting of an equal amount of letters as shown on the face of the selected number playing card. The first player to attain a predetermined level of points is the winner. In addition, special playing cards may be included in the deck of number playing cards to alter the normal playing routine, such as to double the value of the points awarded or reverse the normal order of stating the word.

The composition of cards in both playing decks can be modified by the player to accommodate the player's skill level. For example, higher numbered number playing cards can be removed from the number deck so players will not have to communicate words requiring a large amount of letters. Also, certain letter cards, e.g., X, Z, etc., may also be removed to lessen the difficulty communicating uncommon words beginning with such letters.

In another embodiment of the invention, a method of playing the word game is provided. The method comprises the steps of providing a deck of letter playing cards and a deck of number playing cards. A card from each deck of playing cards is selected and the players attempt to communicate a word in response to the selected playing cards. As mentioned above, the decks of playing cards may be modified to adjust the game's level of playing difficulty for varying skill levels.

A further embodiment includes playing the word game on an electronic device. The device can be an individual, hand-held apparatus having a display means or a larger apparatus such as a personal computer. Furthermore, the word game can be installed on the Internet to be played by players from remote locations. The word game resides on a web page and players interact to play the game similar to a chat room.

Other features and advantages of the invention, which are believed to be novel and nonobvious, will be apparent from the following specification taken in conjunction with the accompanying drawings in which there is shown a preferred embodiment of the invention. Reference is made to the claims for interpreting the full scope of the invention which is not necessarily represented by such embodiment.

BRIEF DESCRIPTION OF THE DRAWINGS

FIG. 5 is an illustration of electronic means capable of running and displaying a software version of the word game;

FIG. 6 is an illustration of electronic means capable of running and displaying a software version of the word game;

DETAILED DESCRIPTION

Figure 1:
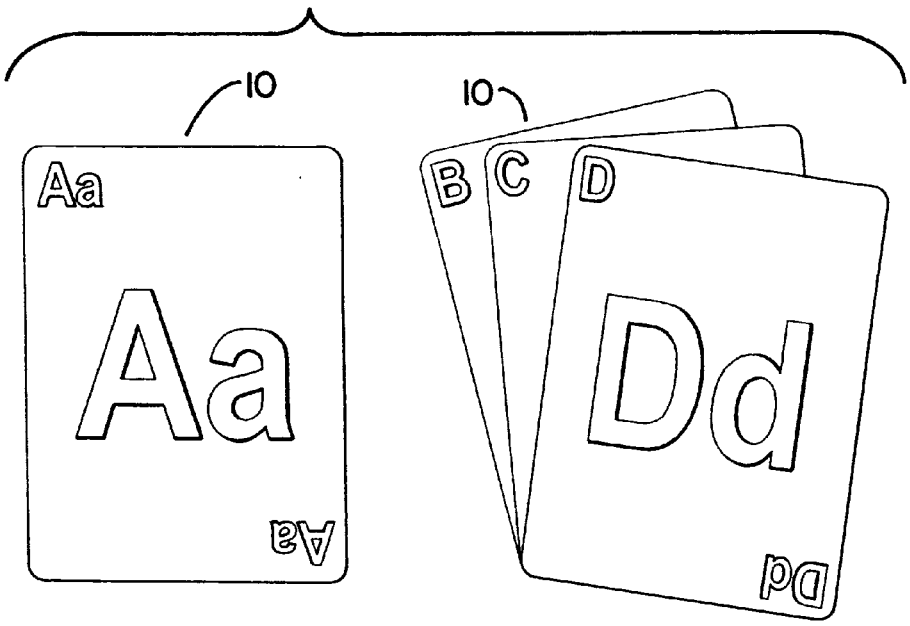
FIG. 1 is an illustration of examples of letter playing cards of one embodiment of the game apparatus of the present invention.

Although this invention is susceptible to embodiments of many different forms, a preferred embodiment will be described and illustrated in detail herein. The present disclosure exemplifies the principles of the invention and is not to be considered a limit to the broader aspects of the invention to the particular embodiment as described.

With reference to FIGS. 1–4, the game apparatus of the present invention preferably includes two decks of playing cards, i.e., a letter deck 10 and a number deck 12; a timer 18, preferably digital; and a score pad 20. In addition, the participants may also find it useful to include a dictionary, a scratch pad of paper and writing instruments 22.

FIG. 1 depicts a deck of letter playing cards 10. The deck of letter playing cards 10 preferably includes fifty-two (52) cards comprising two (2) cards for each letter of the English alphabet. In addition, letter cards can include a combination of letters, i.e., "th," "st," "ph," "sh," etc.

Figure 2:
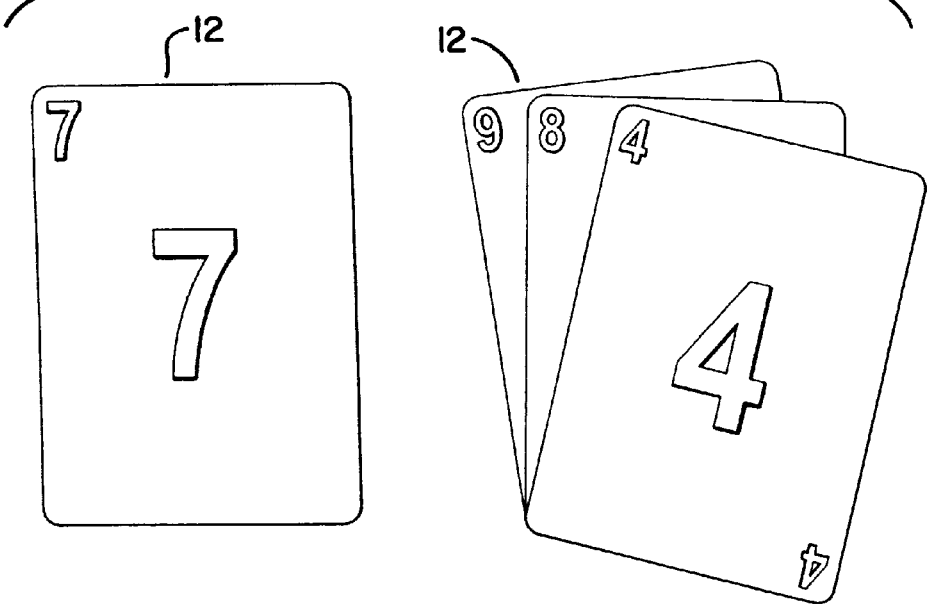
FIG. 2 is an illustration of examples of number playing cards of one embodiment of the game apparatus of the present invention.
Figure 3:
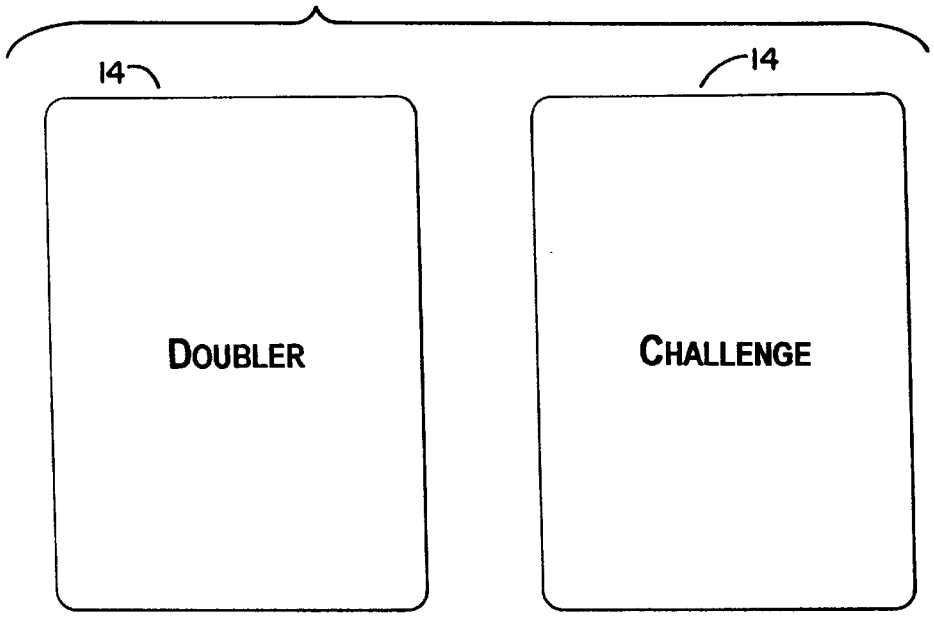
FIG. 3 is an illustration of examples of special playing cards of one embodiment of the game apparatus of the present invention.
Figure 4:
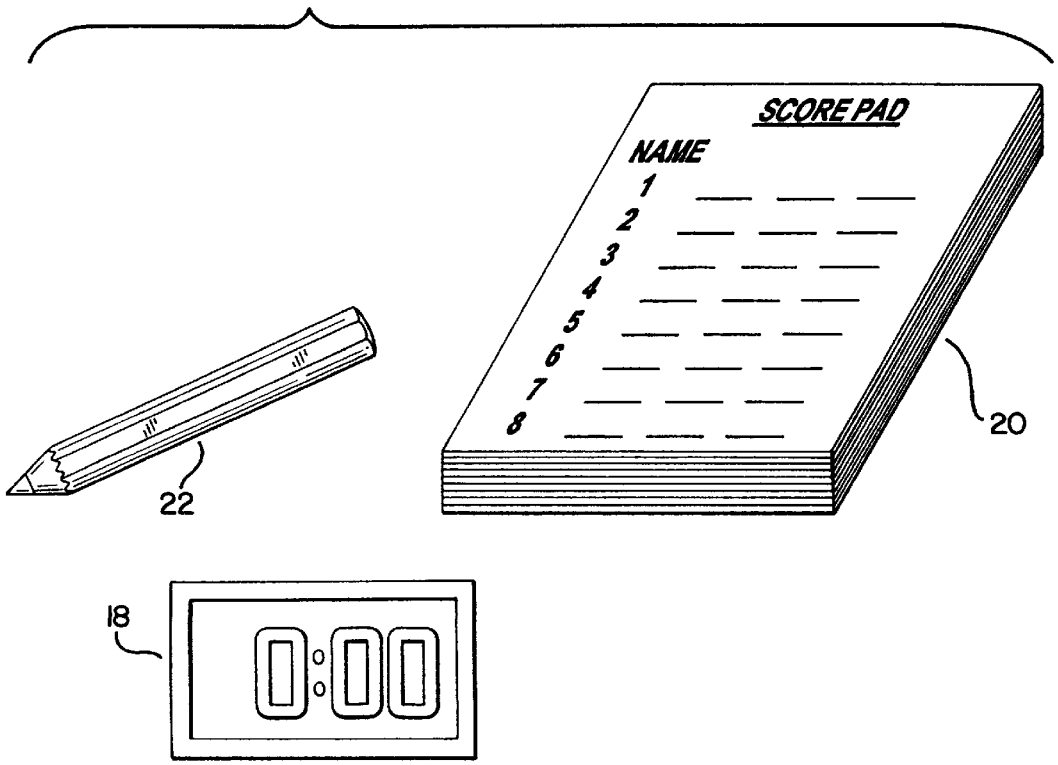
FIG. 4 is an illustration of some of the articles that can be used with, and can be a part of, a further embodiment of the game apparatus.

FIG. 2 depicts a deck of number playing cards 12. The deck of number playing cards 12 preferably includes fifty-seven (57) cards. Forty-four (44) of the number playing cards 12 have a face value ranging from 3–12. The remainder of the number playing deck 12 comprises a plurality of special playing cards 14. The special playing cards 14 are designated "Doubler," "Reverse," "Challenge" and "Syllable." The special playing cards 14 alter the normal play of the word game during a round. The object of the game is to be the first to reach or surpass a predetermined level of points or point goal.

In one embodiment of the invention, players or teams face off against each other and a point goal is determined to designate the end of the game. Each deck of playing cards is shuffled and positioned face down. The first face-off, or round, of play begins by selecting or flipping over a card from each deck for all players to see. Players can alternate selecting playing cards from the decks or can designate a third party to select playing cards. The player selecting a playing card can announce the identity of that playing card to all players. After the two cards have been selected and announced, a timer 18 can be started and the players race to be the first to communicate a word in response to the letter and number playing cards selected, i.e., beginning with the letter, or letters, of the letter(s) shown on the selected letter playing card 10 and consisting of the exact amount of letters as shown on the face of the selected number playing card 12. Alternatively, words may be communicated that include an equal or greater amount of letters as shown on the face of the selected number playing card 12, but not less than the amount.

For example, if a combination of a "B" and a "6" are shown on the selected or flipped playing cards, the player must communicate a word that begins with "B" and has "6" letters, e.g., broken. A player may communicate a word by either speaking, spelling, typing, writing or signing the word. Communicated words may be written on chalk boards, white board, or preferably, paper. In one embodiment, the players are not allowed to hold a writing instrument 22 until all the playing cards are selected and the timer is started. If a writing instrument 22 is dropped, a player cannot pick it up until the round is over. The first player to successfully communicate a word in response to the criteria of the selected playing cards before time expires in the round is awarded an amount of points equal to the face value shown on the number playing card 12 selected for that particular round.

Alternative scoring methods are also contemplated wherein additional points can be awarded in relation to the time remaining in the round after a word has been communicated by a player, i.e., 1 point for each second remaining on the timer; a flat score for a designated amount of time remaining, i.e., 15 seconds, remaining on the timer. A timer, preferably digital, can be used to monitor the mutually agreed upon playing time per face-off, or round, e.g., 30 seconds.

If no player correctly communicates a word before time expires, the point value is shelved to the next round having the exact same letter/number requirement combination and is added to the value of the points determined by the numeric number playing card 12 of that round. Alternatively, the unclaimed points may be shelved and added to the immediate next round, or, the unclaimed points may be disregarded and the game continues to the next face-off without the unclaimed points. The word game continues with additional face-offs until one player or team attains or surpasses the predetermined point goal. If it is determined that the winner must attain the exact predetermined point goal to end the game, players winning more points during a round than required to reach the point goal exactly are not awarded any points for that round. For example, prior to the start of the game, an exact point goal of fifty (50) points is determined by the players to designate the end of the game. Player A has forty-five (45) points and Player B has forty-four (44) points. The letter and number card combination of "B" and "6" is selected. Player A is the first player to communicate a word satisfying the letter/number criteria, i.e., basket. However, adding six (6) points to Player A's total surpasses the predetermined goal of fifty (50) points. Thus, Player A is not awarded any points for being the first to communicate a word for that face-off. However, Player A has prevented Player B from attaining the six (6) points. If the predetermined point goal was established as a goal to attain or surpass, Player A would be the winner having had attained the six (6) additional points for a total of fifty-one (51) points.

Similarly, a player cannot attain a total score if he would later be precluded from attaining the exact point goal. For example, if an exact point goal of fifty (50) points is determined and Player A has forty-five (45) points, Player A cannot win an amount of points that would later preclude him from attaining an exact score of fifty (50) points. If the numbers of the number deck range in value from 3–12, Player A cannot attain a score total within a value of less than three (3) of the point goal because Player A would never be able to attain an exact score of fifty (50) points since there are no number playing cards 12 having avalue less than three (3) points. Further rounds of play continue until one player attains the exact predetermined point goal.

In the preferred embodiment, a situation can arise during play wherein a player's point total is within a value of the point goal that is less than the lowest value of a number playing card 12, i.e., within less than three (3) points of the point goal for the preferred embodiment having a range of number playing cards 12 from 3–12. Thus, the player is seemingly unable to attain an exact score equal to the point goal because there is no number playing card value of two (2) points or less. In this situation only, the selection of a special playing card 14 will function as a "wild" card and will adjust the value of the points to be awarded to be equal to the points required to exactly reach the predetermined point goal. However, the word to be communicated must still satisfy the criteria of the special playing card 14 and the number playing card 12. For example, Player A has forty-eight (48) points and a predetermined point goal of fifty (50) points has been established. A number playing card 12 having a value of five (5) is selected along with a special playing card 14. If Player A can communicate a word having five (5) letters and also satisfying the special card requirement, Player A will be awarded two (2) points to get his point total to equal fifty (50) points exactly.

Special playing cards 14 within the deck of number playing cards 12 affect the method of play for a specific round. In situations where a special playing card 14 has been selected from the deck of number playing cards 12, additional number playing cards 12 are immediately selected until a number playing card 12 having a numeric face value is selected. Once a numeric number playing card 12 has been selected, the round is played according to the rules of the last special playing card 14 that was flipped over. For example, when a "Doubler" special playing card 14 is flipped over and the next playing card flipped over is a number playing card 12 having a numeric face value, the point value of the number playing card 12 is doubled; however, the amount of letters to be used to form a word is not doubled. As another example, if a "Doubler" special playing card 14 is flipped over, followed by a "Challenge" special playing card 14 and then a number playing card 12 having a numeric face value, the round is played according to the Challenge rules for the point value of the number playing card 12.

The selection of a "Challenge" special playing card 14 from the number playing deck 12 challenges the point value of the next immediate numeric number playing card 12 being flipped over. The first player to communicate a word satisfying the letter and number criteria is awarded the point value on the face of the number playing card 12 while any player that failed will have that point value subtracted from their score total.

In the case of a "Reverse" special playing card 14 being flipped over, the players will attempt to be the first to communicate a word ending in the letter of the letter playing card 10 selected and consisting of the same amount of letters as shown on the face value of the flipped number playing card 12, e.g., "cook" is an acceptable word for a flipped combination of a "4" a "Reverse" and a "K" card.

The "Syllable" special card requires the player to communicate words having an amount of syllables equal to the face value shown on the next immediate numeric number playing card 12 flipped. The first player to do so wins the point value. Another embodiment of the word game substitutes the use of syllables in place of letters wherein all communicated words must use syllables equal to the numeric face value of the associated number playing card 12.

Other types of special playing cards 14 are contemplated by the present invention and examples presented above are for illustration purposes only and are not meant to limit the scope of the invention. For example, other special cards can require players to communicate a word for a food, color, name, state, person, city, country, animal, etc.

The word game apparatus can also be played by a single player in a solitaire mode. The sole player can race against a clock to achieve a predetermined point goal before time expires. For example, achieving fifty (50) points in five (5) minutes.

The game can be played in almost any language and can also be modified depending upon the skill level of the participants. For example, the amount of time on the timer can be altered or eliminated altogether. Also, number playing cards 12 with high face values can be removed from the deck when the game is played by young children or less skilled players. The level of difficulty is adjusted by removing certain number playing cards 12, e.g., number playing cards 12 having a face value greater than six (6). In addition, certain letter playing cards 10 can be removed from the playing deck, e.g., X, Q, etc.

Other rules can include prohibiting players from communicating words that are proper names or abbreviations; and receiving assistance from other players. In games between competing teams, individual players may or may not be allowed to participate in each face-off. In situations where an individual team player solely represents the team during a face-off, that player can be allowed to pass his turn to a fellow teammate. If that team wins the face-off, a point is subtracted from the face value of the number playing card 12 for each pass used by the team during the round.

A dictionary can be used to settle disputes between players involving the correct spelling of a word. One or more points are awarded to the player or team successful in the dispute and one or more points are subtracted from the player or team who is unsuccessful in the dispute. In addition, words previously communicated during earlier face-offs cannot be used again. A predetermined amount of points is subtracted from the total points of any player attempting to use a previously communicated word.

Further embodiments of the present invention are shown in FIGS. 5–6 and include incorporating the word game apparatus within electronic and display means. A device such as a personal computer 30, FIG. 5, or handheld device 32, FIG. 6, has means for operating a software program incorporating the word game discussed above. The device is capable of displaying card-like representations of the letter 10 and number playing cards 12. The playing cards are displayed on a LCD screen 34, monitor 36 or speaker 38. An input means is operably connected to the device and is used by the players to interact among themselves and with the word game. The input means can be a keyboard 40, mouse 42, keypad 44 or any other peripheral input device wherein the players can interact with the device.

Once play begins, the device automatically selects cards for each face-off, keeps score, determines which player first communicated a word and keeps track of the words that were communicated during play. The device displays and/or announces the playing cards selected and the players can either communicate a word amongst themselves or be required to enter a word into the device. There can be several inputs to the device for use by multiple players. Individual hand held devices can be communicably linked together. FIG. 9.

Figure 7:
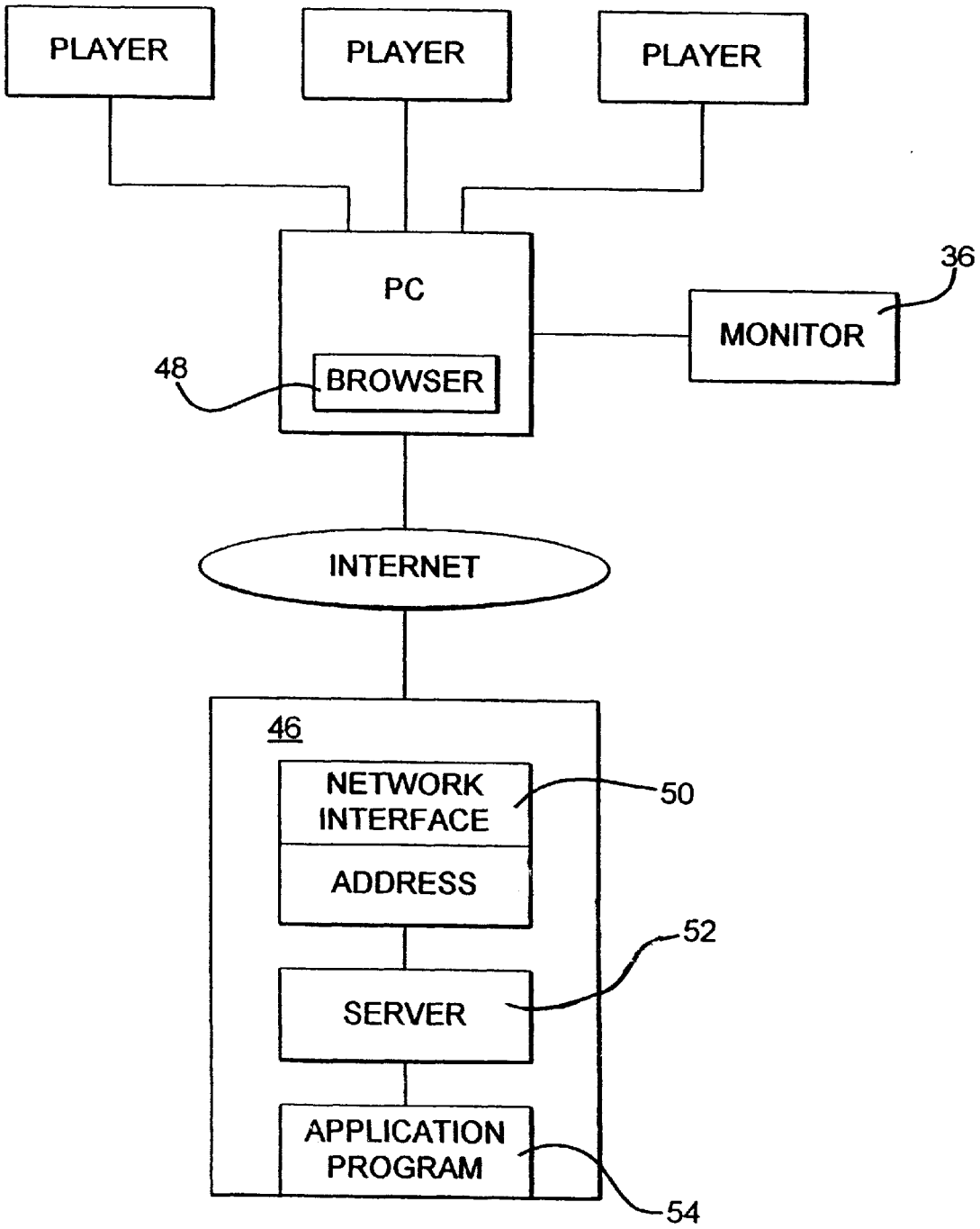
FIG. 7 is a block diagram of the present invention incorporating the electronic means of FIG. 5 on a network
Figure 8:
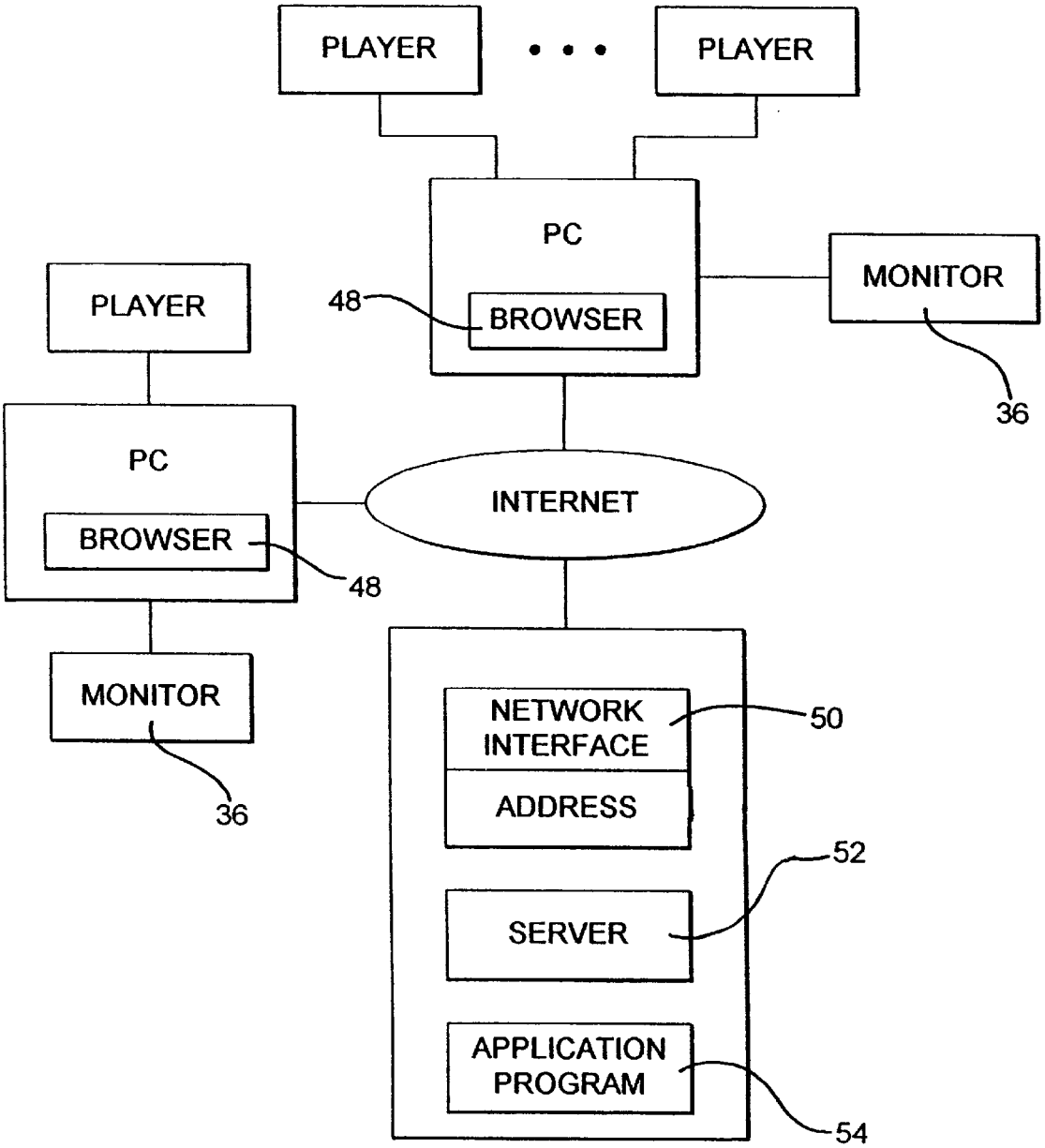
FIG. 8 is a block diagram of the present invention incorporating the electronic means of FIG. 5 a network; and, FIG. 9 is a block diagram of the present invention incorporating the electronic means of FIG. 6 on a network.

Another embodiment of the present invention includes implementing the word game apparatus on a network, preferably the Internet. FIGS. 7 and 8 show an overview block diagram illustrating the relationship between the players at a remote location and an Internet web site 46 used for playing the word game. The players use a device such as a PC, personal digital assistant (PDA), cellular phone or any other electronic device having a commercially available browser 48. The browser 48 is a graphical software program that communicates with the Internet web site 46 and displays information available on the web site 46 through the Internet. Various browser programs 48 are commercially available from different manufacturers such as Netscape Communication's Navigator or Microsoft's Internet Explorer.

The web site 46 includes a network interface 50 having an unique Internet address, a server 52, and an application program 54. The server 52 acts as a hypertext transfer protocol (HTTP) interpreter which uses a protocol, preferably Transmission Control Protocol (TCP) in conjunction with Internet Protocol, through a Transmission Control Protocol/Internet Protocol (TCP/IP) stack to interact with the network interface 50 and the application program 54. This enables the players to interact with the word game application program 54. The application program 54 provides data from the word game that is displayed to players at a remote location.

Communication over the Internet and other networks requires one of several types of protocols. A Sun Microsystem programming language known as Java, along with Hypertext Markup Language (HTML) used in designing layouts and graphics for a Web site or page has extended Internet technology such that a web site can be used for dynamic applications, commonly called applets, that can be downloaded and run by the end user. The Java, HTML or a similar programming application resides within the device. These applets are interpreted and run within the web browser 48.

The players connect to the Internet using one of a number of Internet service providers and will enter the address of the web site 46 when connected. The web site 46 will display a web page which may contain text, some type of multimedia representation such as graphic images, video, or audio, and possible hypertext links to other documents such as rules, high scores, a dictionary, etc.

While the specific embodiments have been illustrated and described, numerous modifications are possible without departing from the scope or spirit of the invention.

We claim:

1. A word game for playing among several participants and being easily adaptable to various skill levels, the game comprising:

a deck of letter playing cards, each letter playing card consisting of either a single letter or a pair of letters;

a deck of number playing cards, each number playing card having a single number, both decks of playing cards being easily adaptable to several skill levels by removing one or more playing cards from either deck to match the skill level of the participants; and, a set of special playing cards interspersed within the deck of number playing cards, the special playing card selected from the group consisting of doubler, reverse, challenge, and syllable, wherein the participants attempt to create a word in response to the card selected from the deck of number playing cards and the card selected from the deck of letter playing cards.

2. The word game of claim 1 further including a timer and a score pad.

3. A method of playing a word game among several participants, the game being capable of varying complexity and including a deck of letter playing cards and a deck of number playing cards, each letter playing card consisting of either a single letter or a pair of letters, and each number playing card including a single number, the method comprising the steps of:

providing a set of special playing cards, the special playing cards being interspersed within the deck of number playing cards, each special playing card being selected from the group consisting of challenge, doubler, reverse, and syllable;

selecting a playing card from each deck of playing cards;

displaying the selected playing cards to the participants;

creating a word in response to the selected playing cards;

stating the created word.

4. The method of claim 3 further comprising the step of matching the complexity of the game to the participant's skill level by manipulating the composition of either deck of playing cards.

* * * * *